United States Patent [19]

Murakawa et al.

[11] 4,177,757

[45] Dec. 11, 1979

[54] MAGNETIC BRUSH DEVELOPING DEVICE FOR DEVELOPING ELECTROSTATIC LATENT IMAGES

[75] Inventors: Syuzi Murakawa; Toshirou Kasamura; Yujiro Ando, all of Yokohama, Japan

[73] Assignee: Canon Kabushiki Kaisha, Tokyo, Japan

[21] Appl. No.: 863,438

[22] Filed: Dec. 22, 1977

[30] Foreign Application Priority Data

Jan. 7, 1977 [JP] Japan ..... 52-585

[51] Int. Cl.[2] ..... G03G 13/09

[52] U.S. Cl. ..... 118/658; 430/122

[58] Field of Search ..... 118/653, 655, 657, 658, 118/656; 427/18

[56] References Cited

U.S. PATENT DOCUMENTS

| | | | |
|---|---|---|---|
| 3,575,139 | 4/1971 | Nuzum | 118/658 |
| 3,641,980 | 2/1972 | Bickmore | 427/18 |
| 3,939,801 | 2/1976 | Tanaka et al. | 118/658 |
| 3,952,701 | 4/1976 | Yamashita et al. | 118/658 |
| 4,030,447 | 6/1977 | Takahashi et al. | 118/658 |
| 4,048,957 | 9/1977 | Tagawa | 118/658 |
| 4,063,533 | 12/1977 | White | 118/658 |
| 4,075,977 | 2/1978 | Williams | 118/658 |

*Primary Examiner*—Mervin Stein

*Attorney, Agent, or Firm*—Fitzpatrick, Cella, Harper & Scinto

[57] ABSTRACT

In a device for developing electrostatic images with developer mix including magnetic carrier particles and triboelectrically charged toner particles which comprises a container for the developer mix, magnetic field producing means and an applicator enclosing the magnetic field producing means, a magnetic brush forming means is provided in the container for applying toner particles substantially uniformly to a surface to be developed, and a toner powder-cloud forming means is provided in spaced apart relationship with the magnetic brush forming means for applying toner particles to the same surface by the use of the edge effect of the toner powder.

15 Claims, 10 Drawing Figures

MAGNETIC BRUSH DEVELOPING DEVICE FOR DEVELOPING ELECTROSTATIC LATENT IMAGES

BACKGROUND OF THE INVENTION

1. Field of the Invention

This invention relates to a magnetic brush developing device for developing electrostatic latent images.

2. Description of the Prior Art

For example, in image formation apparatuses such as electrophotographic copying machines and the like, the known developing devices applicable to these copying machines have resorted to the powder-cloud method, the cascade method, the magnetic brush method or the like and these have their own distinct characteristics and have been put into use in various fields in accordance with those characteristics.

The powder-cloud method or the cascade method has a merit in reproducibility, i.e., line copy, of business documents due to the occurrence of the so-called edge effect whereby developing toner is concentrated on those portions of an electrostatic latent image on the latent image bearing surface of a photosensitive medium or the like which have a great gradient of electric field, namely, those portions of the latent image in which the density of the original image is discontinuous and such portions are emphatically reproduced. On the other hand, this presents itself as a demerit in the reproduction of ordinary tone images (images containing half-tone density), namely, in the reproduction of those portions of an original image in which density is continuously varied. Also, in both of the powder-cloud method and the cascade method, the necessity of widening the area of the latent image bearing surface which is acted on by developer has led to a disadvantage of bulkiness of the developing device itself.

In contrast, the magnetic brush method comprises causing a magnet to attract a developer composed of a mixture of iron powder carrier and developing toner, forming the developer in a brush-like shape in the magnetic pole portion, and causing such developer to frictionally contact an electrostatic latent image on the latent image bearing member, thereby developing the latent image to obtain a reproduction of an image. The iron powder itself acts as a soft developing electrode and thus, it enables the developing toner to be deposited in proportion to the charge density of the electrostatic latent image. Thus, the magnetic brush method is suited for the reproduction of toner images. Further, this method is featurized in that it permits compactness of the developing device itself.

As an improvement over the magnetic brush developing device, a system is known in which a non-magnetic member is disposed around a magnet bar having poles of the opposite polarities alternately arranged circumferentially thereof and these two are moved relative to each other to thereby form magnetic brushes in the surface portions of the non-magnetic member corresponding to the magnetic poles so that the magnetic brushes softly and frictionally touch the surface to be developed, thus developing a latent image thereon.

Such a magnetic brush developing device according to the prior art has involved a difficult problem in the reproducibility of the density of original image. The reason is that once the toner, which is deposited on a copying medium, usually a sheet of paper, has covered the copying medium in the form of one or two layers, the density of the copy image is no longer varied but assumes saturated condition even if the number of the toner layers is increased. Because of this, the copy image will be very hard in visual impression as compared with the original image. In order to soften the impression of such copy image in an effort to approximate it to that of the original image, the quantity of toner deposited must generally be decreased, whereas this has in turn resulted in reduced reproducibility of character images.

Also, in the device of this type, an effort to utilize the repelling magnetic fields of the magnetic means has often encountered difficulties in transporting the magnetic developing material from the developing container to the developing station and there is known no method which perfectly utilizes the repelling magnetic fields as well as the coaction thereof with the centrifugal force, gravity, inertia force, etc. of the developing material.

A solution to these problems is disclosed in U.S. Pat. No. 4,030,447 issued to the assignee in common with that of the present invention (see column 5, line 7 to column 8, line 21 and FIGS. 3(A) to 8), wherein there is shown a developing device having two magnetic poles of identical polarity disposed in opposed relationship with a latent image bearing surface. By so arranging the two poles of identical polarity, the developing toner transported with a non-magnetic cylinder (hereinafter referred to as the sleeve) is caused to form brushes at the pole positions to effect development peculiar to such brushes and between the poles, the developing toner jumps from the surface of the sleeve to the latent image surface by the repelling magnetic fields while it is downwardly dropped by the actions of centrifugal force, gravity and inertia force, as a result of which there may be achieved an effect peculiar to both the cascade development and the cloud development. However, if the latent image bearing member was rapidly moved to enhance the image formation speed, it has been found that the developing capability was reduced in the developing device using the above-described method.

On the other hand, a technique in which two magnetic brushes are opposed to a latent image bearing surface and one blanket of developing material is formed in order to achieve rapid development is known from U.S. Pat. No. 3,640,248. The specification (column 1, line 58 to column 3, line 75) and FIG. 2 of this patent show two non-magnetic sleeves disposed in spaced relation around a magnet having a pair of poles (N-S) so that one magnetic blanket of the developer is formed across the open space between the two sleeves.

Similarly, techniques in which two parallel sleeves are disposed in opposed relationship with an electrostatic latent image bearing surface are known from U.S. Pat. No. 3,543,720 (FIG. 1 and column 3, line 24 to column 4, line 43) and German Pat. No. 1218287 (FIG. 3 and column 5, line 11 to column 6, line 2).

The constructions of these three prior art publications are common with one another in that two substantially symmetric magnets and a sleeve surrounding them are disposed in entirely parallel, opposed relationship with the electrostatic latent image carrier, and particularly in that each of the magnets has a pair of N-S poles or a plurality of pairs of alternately arranged N-S poles. In other words, these constructions are intended simply to widen the developing zone and none of them shows a special contrivance of magnet pole arrangement which will provide qualitative differences between the configurations of the magnetic brushes on the respective sleeves and between the developing methods carried out thereby. For example, the aforementioned U.S. Pat. No. 3,543,720 teaches that the rotational velocity of the second sleeve is made slower than that of the first sleeve, but this is only intended to permit the more of toner to accumulate in the open space between the two sleeves and be brought into contact with the latent image bearing member, and in regard to the arrangement of the magnetic poles directly concerned with development and the polarities of these poles, it forms no difference from the methods of the conventional types in which different magnetic poles are alternately arranged.

SUMMARY OF THE INVENTION

It is an object of the present invention to provide a device for forming a plurality of appropriate and improved magnetic brushes for rapid development.

It is another object of the present invention to provide a device which has at least two magnetic brush formation means capable of forming differently configured magnetic brushes and imparting qualitatively different developments to an electrostatic image formation surface in overlapped relation to thereby enable rapid and excellent development.

It is still another object of the present invention to provide a device which is provided with first and second magnetic brush formation means and in which one of the magnetic brushes is effective to emphasize the edge effect and the other to weaken the edge effect during development.

It is yet still another object of the present invention to provide a device in which two different developing methods may be carried out in combination, namely, the first magnetic brush is capable of carrying out the conventional sleeve type developing method and the second magnetic brush is capable of carrying out the powder-cloud developing method.

It is a further object of the present invention to provide a device in which magnetic brush formation means having two magnetic poles of identical polarity at the developing position and magnetic brush formation means having at the developing position a single magnetic pole opposite in polarity to said two poles are disposed in opposed relationship with a surface to be developed so that image reproduction of high quality can be achieved by a combination of the two magnetic brush formation means.

According to a preferred embodiment of the present invention which can achieve the above objects, there is provided a developing device which comprises a first developing portion having a single magnetic pole disposed with a sleeve disposed in opposed relationship with an electrostatic image bearing surface and a second developing portion spaced apart from said first developing portion and having at least two magnetic poles of identical polarity, opposite to that of said single magnetic pole, disposed within a sleeve in opposed relationship with the electrostatic image bearing surface.

In a more preferred embodiment of such developing device, the two sleeves may be rotated in the same direction with respect to the movable electrostatic image bearing surface and the first developing portion may be located upstream of the second developing portion. In such case, at the first developing portion, development is effected by a magnetic brush grown on the single magnetic pole and this development is excellent in reproducibility of half-tone images due to the developing electrode effect of the iron powder carrier in the developer over the sleeve and suppresses the edge effect. Thereafter, the developer so used is not stirred but transported toward the second developing portion with the rotation of the sleeve. At the second developing portion, the developer coming from the first developing portion is subjected to the action of the magnetic poles opposite in polarity to that of the first developing portion. Since these poles are identical in polarity to each other, the carrier jumps up from the sleeve surface due to the repelling magnetic fields between these identical poles, thereby creating a developing effect similar to the powder-cloud development between the two magnetic poles, as well as a developing effect similar to the cascade development wherein the developer in the cloud phase jumps from one of the two identical poles to the other with the rotation of the sleeve. Due to such jumping, no carrier layer is present on the sleeve surface and the so-called developing electrode effect is correspondingly reduced to permit the edge effect to present itself, thus developing the marginal area of the image intensely.

Accordingly, the electrostatic image bearing surface is subjected to different developing effects successively at the first and the second developing portion, so that toner layers resulting from such different developments are overlaid on the same portion of the image, and this leads to better reproduction of half-tone images as well as clear and sharp reproduction of the image outlines.

Other objects and features of the present invention will become fully apparent from the following detailed description of the invention taken in conjunction with the accompanying drawings.

DESCRIPTION OF THE PREFERRED EMBODIMENTS

Figure 1A:
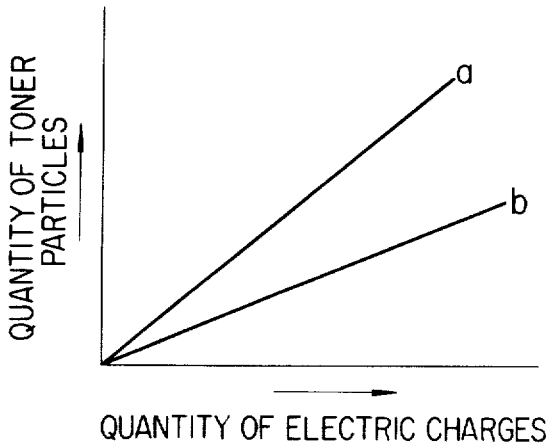
FIG. 1(A) is a graph illustrating the relation between quantity of electric charges and quantity of deposited toner.
Figure 1B:
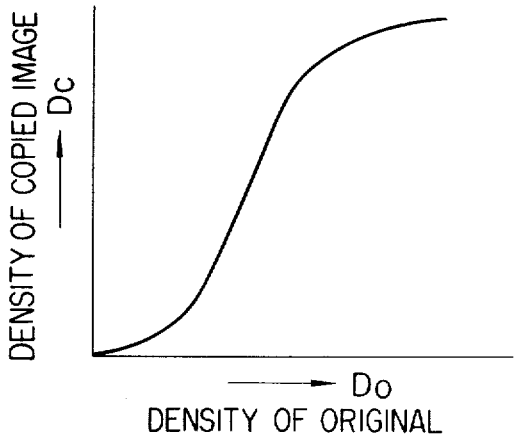
FIG. 1(B) is a graph illustrating the relation between density of original image and density of copy image.

Reference will first be had to FIGS. 1(A) and 1(B) to describe the relation between the original image and the copy image during the image reproduction effected by the magnetic brush developing device according to the prior art. The relation between the quantity of charges of the electrostatic latent image on a surface to be developed and the quantity of developing toner deposited thereon according to the prior art method is such as indicated by line a in FIG. 1(A). That is, the quantity of charges and the quantity of toner deposited are in proportional relationship with each other, and when such relation is represented in terms of the original image density $D_O$-copy image density $D_c$ characteristic of the copy image as shown in FIG. 1(B), it will be seen that $D_c$ assumes saturated condition at a predetermined value of the original image density $D_o$. Therefore, the tone image can no longer be identified in the area of the image which has the predetermined or greater density. This shows that once the toner has been deposited in one or two layers over the copying medium, the copy image density $D_c$ is never varied even if the toner layers are further increased, and such a copy image will give a visual impression as a very hard tone image. In order to soften such impression of the image, the quantity of toner deposited must have such a characteristic as indicated by line b in FIG. 1(A), whereas this will involve a disadvantage that the reproducibility of the character image is reduced.

Figure 2:
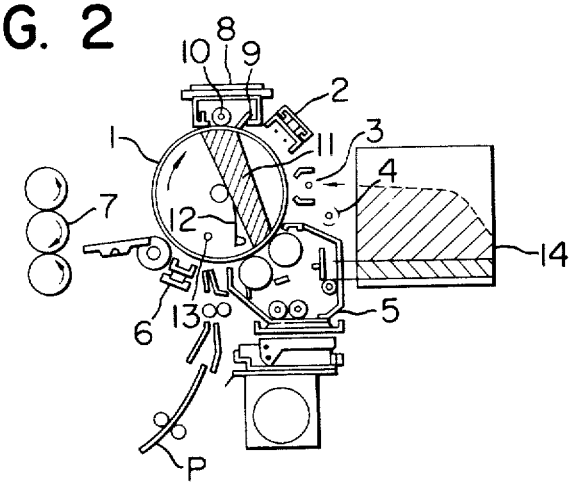
FIG. 2 is a front view showing essential portions of an electrophotographic copying machine to which the developing device of the present invention is applied.

FIG. 2 schematically illustrates an example of the inventive developing device which eliminates the above-noted disadvantages, as it is applied to an electrophotographic copying machine of the image transfer type. In FIG. 2, reference numeral 1 designates a drum-shaped photosensitive medium for electrophotography comprising an insulating layer, a photoconductive layer and a conductive back-up layer. The surface of the photosensitive medium is uniformly charged to any desired polarity by a primary corona discharger 2, and then subjected to simultaneous application of DC corona discharge opposite in polarity to the primary charge or AC corona discharge and image light, by means 3 for simultaneous application of secondary corona discharge and image light. Next, if required, the surface of the photosensitive medium may be subjected to allover exposure by allover exposure means 4 to thereby form thereon an electrostatic latent image with high contrast. The electrostatic latent image is then developed into a visible image by a developing device 5 of the present invention, and the visible image is transferred to a transfer medium P under the effect of the transfer field provided by a transfer corona charger 6. The transfer medium P is then separated from the photosensitive drum, whereafter it is heated for fixation of the transferred image by a fixing roller 7.

After the image transfer, untransferred toner particles on the photosensitive drum are scraped off therefrom by a cleaning blade 9 in a cleaner device 8, whereafter the scraped toner particles are conveyed toward an axial end of the photosensitive drum by a conveyor screw 10 and passed through a toner recovering duct 11 provided in contact with that end of the drun and recovered in the developing device 5 for reuse. To prevent bridging of the toner in the recovering duct 11, a duct beating member (resilient material) 12 is mounted with the duct and a driver pin 13 for the beating member is secured to said end of the photosensitive drum, so that the untransferred toner may be positively recovered into the developing device through the vibrating action provided by the driver pin and the beating member.

The developer has magnetic carrier particles such as iron powder and triboelectrically charged toner particles.

Disposed within the developer device is a toner concentration detector means for detecting the concentration of toner in the developer, which detector means utilizes the well-known carrier-toner breakdown voltage variation detecting method to measure the developing capacity of the developer. By the detection signal from the concentration detector means, replenishment developer is supplied from a hopper 14 at suitable times. The replenishment developer contains therein 40–50% by weight of carrier, and the carrier in the developing device increased by the supply of the replenishment developer overflows from the developing device for discharge. In such method, the fresh carrier in the replenishment developer and the old carrier in the developing device are always in mixed condition so that image reproduction can continue in a stable coondition for a long time. Further, the developing device now under discussion is equipped with novel toner scatter preventing means which eliminates the need to provide a suction blower and a toner filter which were indispensably necessary for the recovery of scattered toner particles in the conventional dry type copying machine, and this in turn enables dry type copying apparatus to be designed.

A specific construction of the developing device according to the present invention will now be described in detail.

Figure 3A:
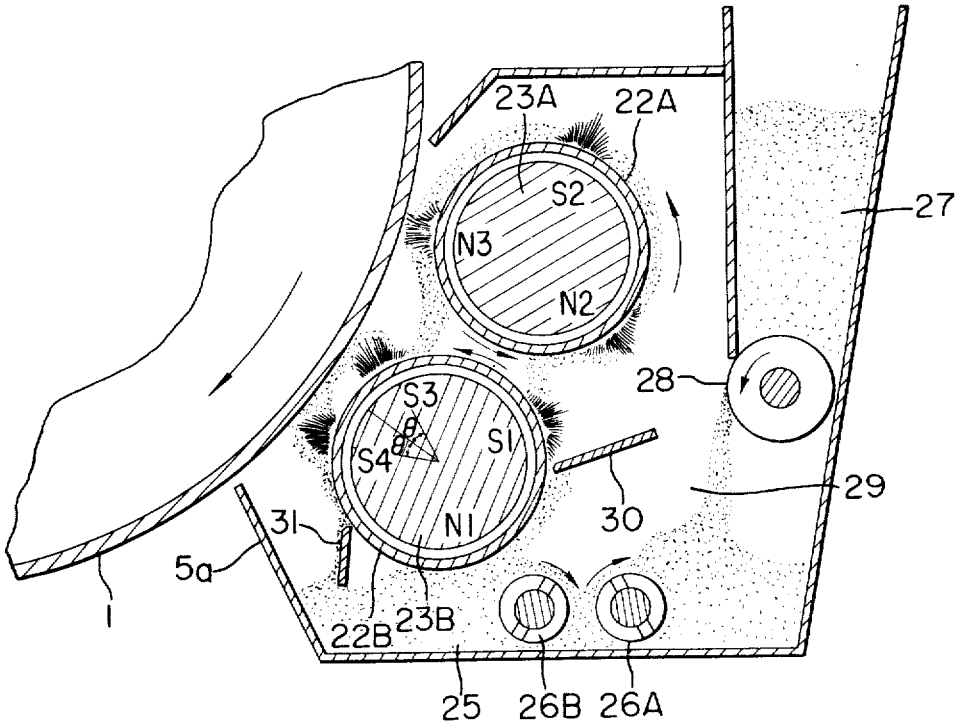
FIG. 3(A) is a cross-sectional view of a first embodiment of the developing device according to the present invention.

FIG. 3(A) shows, in cross-section, an embodiment of the developing device according to the present invention.

Figure 3B:
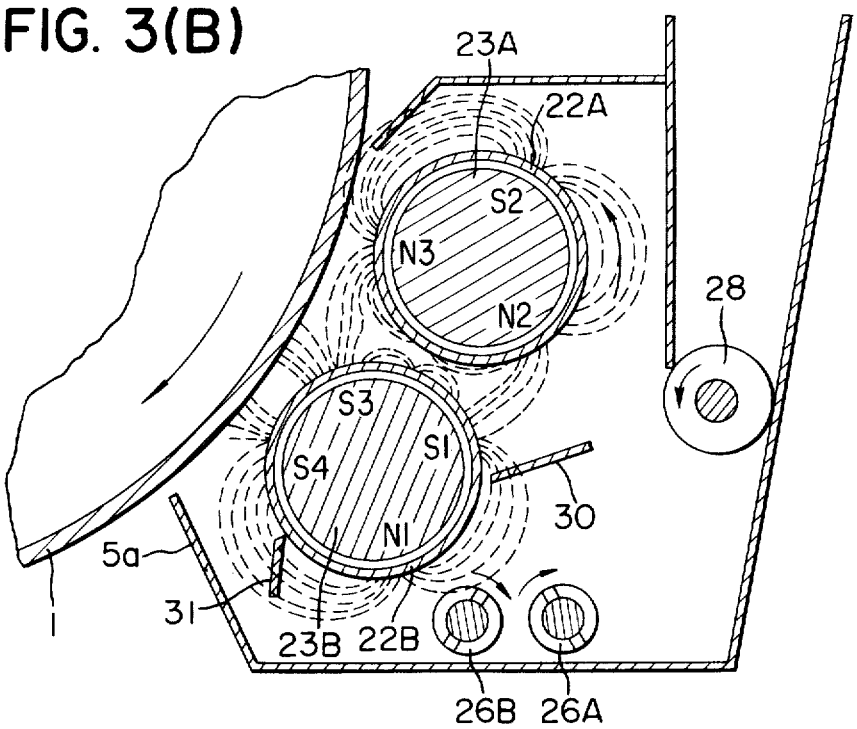
FIG. 3(B) is a cross-sectional view for more clearly illustrating the magnetic fluxes produced by first and second magnetic field producing means in such developing device.

The embodiment shown in FIGS. 3(A) and 3(B) is a device in which two sleeves are disposed in opposed relationship with a drum-shaped electrostatic latent image bearing member and within a zone in which the rotation of the image bearing member is downwardly directed, to thereby develop the electrostatic image on the image bearing member.

In FIG. 3(A), the electrostatic image bearing member 1 is shown to be rotated in the direction of arrow and in the developing portion, two non-magnetic sleeves 22A and 22B are disposed for rotation in the same direction as the member 1 and in a slightly spaced apart relationship with each other. These sleeves are rotatively driven by a known drive means at a peripheral velocity different from that of the electrostatic image bearing member. These two sleeves contain therewithin stationary magnetic means 23A and 23B which are differently magnetized.

Magnetic pole arrangement of the first magnetic means 23A will first be described. The shown magnetic means 23A is formed as a magnet roller having magnetizing poles $N_2$, $S_2$ and $N_3$ equiangularly spaced apart from one another and disposed adjacent to the surface of the roller. The pole $N_3$ is closest to the surface of the electrostatic image bearing member 1.

The second magnetic means 23B is formed as a magnet roller magnetized with four poles as shown. The poles $N_1$ and $S_1$ are functional to pump up and transport developer. The poles $S_3$ and $S_4$ are developing magnetic poles spaced apart by a predetermined angle away from the point whereat this magnet roller is closest to the surface of the electrostatic image bearing member. The developing magnetic poles $S_3$ and $S_4$ of identical polarity are chosen so as to be opposite in polarity to the developing magnetic pole $N_3$ of the first magnetic means.

Designated by 25 is developer contained within the housing 5a of the developing device, which developer consists of a mixture of the aforementioned magnetic carrier and developing toner. The housing also contains therewithin two screws 26A and 26B for stirring the developer 25 in the rotational direction of the sleeve, a blade 30 for controlling the thickness of the developer pumped up onto the surface of the sleeve 23B to a predetermined value, a cleaning blade 31 for removing any residual developer from the sleeve surface after development, a chamber 27 for containing replenishment developer, and a replenishment roller 28 disposed in the lower opening portion of the chamber 27. With the rotation of this roller 28, the developer received in the concave portion provided in the surface of the roller 28 falls into a developing chamber 29 within the housing 5a in which the screws are disposed, thereby replenishing the developer.

The sleeve 22A and the magnetic means 23A together constitute a first developing portion of the present invention, and the sleeve 22B and the magnetic means 23B together constitute a second developing portion of the present invention.

The developing operation in the above-described developing device will now be described by reference to FIG. 3(B). The sleeves 22A and 22B start rotating in synchronism with the rotation of the electrostatic image bearing member 1. With the rotation of these sleeves, developer is deposited on the surface of the sleeve 22B by the magnetic force of the pole $N_1$ of the magnetic means 23B whose flux is shown in FIG. 3(B). The developer so deposited is attracted to the surface of the sleeve 22B by the magnetic forces of the pole $N_1$ and overlying pole $S_1$ whose fluxes are shown in FIG. 3(B), and the deposited developer arrives at the position of the pole $S_1$ while the amount of deposition is uniformly controlled by the developer control plate 30. Having passed by the position of the pole $S_1$, the developer is attracted toward the sleeve 22A by the magnetic force of the pole $N_2$ of the magnetic means 23A shown in FIG. 3(B). The developer having so migrated to the sleeve 22A advances over the sleeve 22A from the position of the pole $S_2$ to the position of the pole $N_3$ by the magnetic force of the pole $S_2$, with the rotation of the sleeve 22A. At the position of the pole $N_3$, the magnetic carrier is erected by the magnetic force of the pole $N_3$ shown in FIG. 3(B), thereby forming a magnetic brush for developing the electrostatic image on the electrostatic image bearing member 1. Thus, at the position of the pole $N_3$, the image bearing member 1 is subjected to the development similar to the conventional magnetic brush development, to thereby form a visible image of rich harmony having a minimized edge effect. The erected developer passes toward the sleeve 22B while becoming quietly collapsed with the rotation of the sleeve 22A. As it approaches the sleeve 22B, the developer on the sleeve 22A is liberated from the magnetic field provided by the pole $N_3$ and attracted by the magnetic force of the other pole $S_3$ of the magnetic means 23B shown in FIG. 3(B), and migrates toward the sleeve 22B. By the magnetic force of the magnetic pole $S_3$, the developer deposited on the sleeve 22B is caused to form a magnetic brush again at the position of the pole $S_3$, thus developing electrostatic image on the image bearing member 1. Due to the presence of the pole $S_4$ close to and below the pole $S_3$ of the same polarity as $S_4$, repelling magnetic fields exist between these poles $S_3$ and $S_4$, as shown in FIG. 3(B). Thus, the developer migrating with the rotation of the sleeve 22B forms a brush at the position of the pole $S_3$, and then passes through the repelling fields. At this time, the developer on the sleeve 22B has no time to collapse its magnetic brush at the position of the pole $S_3$ and is caused to jump toward the electrostatic image bearing member by the action of the repelling fields. The developer having so left the surface of the sleeve 23B develops the electrostatic image bearing member in a manner similar to the powder-cloud development or the cascade development, by the coaction of the centrifugal force, gravity and inertia force of the sleeve 22B and the magnetic field of the underlying pole $S_4$. Thereafter, the developer scattered by the magnetic force of the pole $S_4$ forms a magnetic brush again on the sleeve 22B, thus developing the electrostatic image on the electrostatic image bearing member. Thus, at the developing station whereat the poles of identical polarity of the magnetic means 23B are disposed, there may be provided not only the merit of the conventional magnetic brush method but also the merit of the cascade or the powder-cloud developing method as described, namely, the merit that the edge effect can present itself. After having passed through the developing station, the developer is scraped from the sleeve 22B by the scraper 31 disposed at a location of weaker magnetic force, whereafter the transportation of developer and the developing process is repeated again. In the developing method now under discussion, the carrier of the developer may also be rotated in dependence of the delivery of developer between the sleeves and the condition or the peripheral velocity of the sleeves, so that even if toner is consumed up in the first developing portion, the developer may be appropriately stirred before it reaches the second developing portion.

Incidentally, in the developing device of the above-described embodiment, development is effected with the developer being delivered between the parallel sleeves. Therefore, if the developer on the sleeve is biased or offset toward one side or drops during the delivery or the erection, the resultant magnetic brushes will become irregular and may undesirably cause non-uniform development. However, good delivery of the developer between the sleeves can be realized by suitably selecting the spacing between the sleeves and the arrangement of the poles therein. As regards the erection, when the magnetic brush is formed by the single magnetic pole of the first developing portion, the developer is hardly biased, whereas when the magnetic brushes are formed by a plurality of poles of identical polarity as in the second developing portion, the developer tends to assume a powder form and leave the sleeve because of the strong repelling magnetic fields, thus causing the bias of the developer in question. For this reason, in the above-described developing device wherein the second developing portion having strong repelling fields is used, the second developing portion arranged next to the first developing portion having the single developing pole would lead to a good result. If the repelling fields of the second developing portion are weak, the first and the second developing portion may be arranged in an inverted order, but as regards the direction of transportation of the developer, the vertical or lateral passage of the developer through the repelling fields results in a smooth flow of the developer.

Here it should be noted that the magnetic poles of the second developing portion are disposed in the direction in which the developer is advanced by its gravity and the centrifugal force and inertia force resulting from the rotation of the sleeve, or at least at such positions that the developer is advanced horizontally, whereby smooth transportation of the developer becomes possible. In the present invention, the sleeves are cylindrical members formed of a non-magnetic material such as aluminum alloy, resin or the like. The magnetic means forming the magnetic poles may be provided by magnetized magnetic material or pillar-like magnets secured to fixed members with the magnetic poles facing outwardly, or may be electrical magnetism producing means. The electrostatic image bearing member may be a conventional photosensitive medium for electrophotography, or a cylindrical intermediate medium or sheet member to which an electrostatic latent image is transferable or which bears an otherwisely formed latent image.

Examples of the surface flux densities of the magnetic poles in the embodiment shown in FIGS. 3(A) and (B) will be given below.

| | |
|---|---|
| $N_1$ | 800 gausses |
| $S_1$ | 800 |
| $S_3$ | 650 or 800 |
| $S_4$ | 650 or 800 |
| $N_2$ | 800 |
| $S_2$ | 800 |
| $N_3$ | 800 |

The spacing between the sleeves 22A and 22B is variable with such factors as the intensity of the surface flux density of each pole and the peripheral velocity of the sleeves, but may range from the order of 1 to 5 mm, and may preferably be of the order of 2 mm. Further, the peripheral velocity of the sleeve forming the first developing portion and of the sleeve forming the second developing portion should advantageously be higher than that of the electrostatic image bearing member from the viewpoint of the supply of developer, and preferably about 20% higher than the latter.

Figure 4:
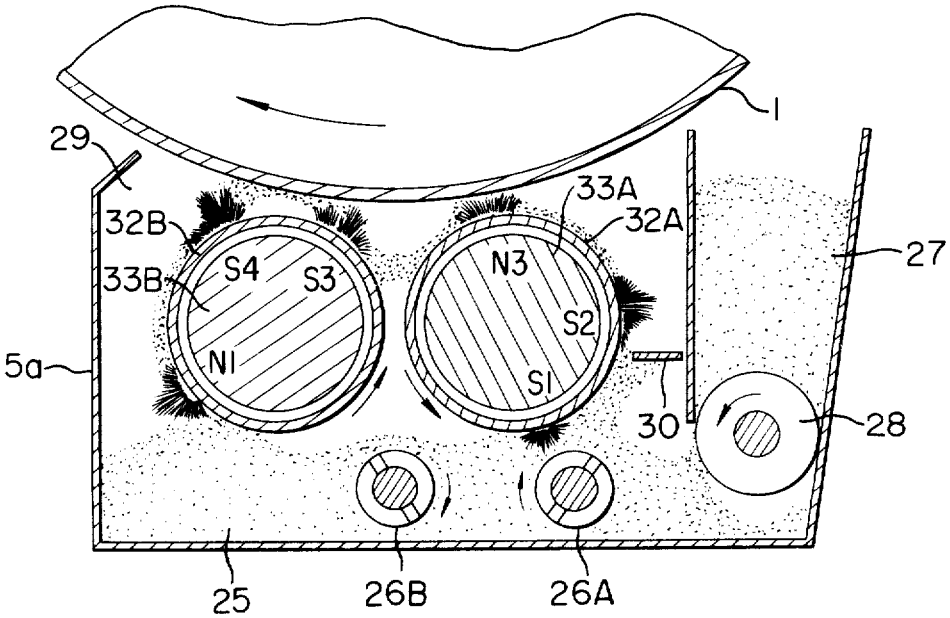
FIGS. 4 and 5 are cross-sectional views showing further embodiments of the developing device according to the present invention.

FIG. 4 shows another embodiment of the present invention in which elements common to those in FIG. 3 are given similar reference characters. In this alternative embodiment, the first and the second developing portion are disposed in laterally parallel relationship. Designated by 32A and 32B are sleeves rotatable in the direction of arrow, namely, the same direction as the electrostatic image bearing member, and 33A and 33B are stationary magnetic means having the shown magnetized poles which substantially correspond to the magnetic means 23A and 23B. The sleeve 32A and the magnetic means 33A together constitute a first developing portion, and the sleeve 32B and the magnetic means 33B together constitute a second developing portion. In this developing device of FIG. 4, the developer attracted to the sleeve 32A forms a magnetic brush at the position of the single developing pole N, thereby effecting the first development. Thereafter, the developer is caused to migrate to the parallel-disposed sleeve 32B by the magnetic force of the magnetic means 33B, and development peculiar to the repelling fields of the magnetic poles S—S takes place at the developing position, whereafter the developer drops from the sleeve 32B. Such laterally parallel arrangement of the first and second developing portions is also possible according to the present invention.

Figure 5:
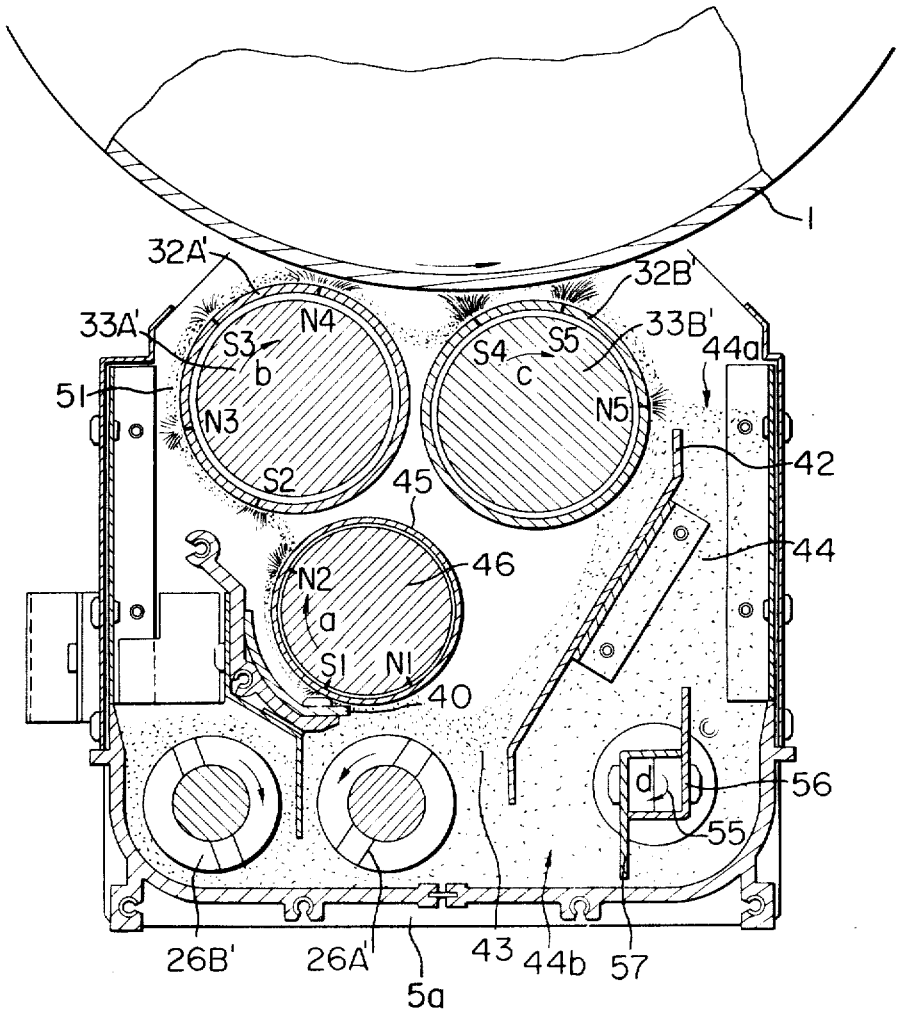

FIG. 5 shows a modification of the FIG. 4 embodiment, in which a developer receiving portion relatively unrelated to the circulation of developer is disposed in the circulation path of the developer so as to ensure a longer life of the developer during rapid development effected by the two sleeves.

Designated by 5a is the housing of the developing device whose interior is divided into a magnetic brush chamber 43 and a storage chamber 44 by a partition plate 42. Denoted by 33A', 33B' and 46 are multipoled pillar-like magnets disposed fixedly and parallel within the magnetic brush chamber 43. Designated by 32A', 32B' and 45 are non-magnetic sleeves surrounding the magnets 33A', 33B' and 46, respectively. These sleeves 32A', 32B' and 45 are rotatable about their respective magnets in the directions of arrows a, b and c, respectively, by drive means (not shown) installed for the developing device. Magnetic brushes, designated at 51, are formed by the developer being attracted and converged around the sleeves 45, 32A', 32B' by the permeating forces of the poles of the magnet 46, 33A', 33B', and such magnetic brushes are brought into contact with the surface of the electrostatic image bearing member 1 to thereby visualize the latent image.

The magnet 33A' has a single pole $N_4$ at the developing zone, and cooperates with the sleeve 32A' to constitute a first developing portion, as already noted. The magnet 33B' has a pair of identical poles $S_4$ and $S_5$ opposite in polarity to the aforementioned single pole, and cooperates with the sleeve 32B' to constitute a second developing portion, as already noted. The third sleeve 45 and its magnet 46 together constitute means for supplying developer to the first developing portion from therebelow.

The developing functions taking place in the first and second developing portions are similar to those described with respect to FIG. 4 and need not be described in detail.

Designated by 26A' and 26B' are stirring members such as screws or the like for stirring the developer. These stirring members are disposed in proximity to the magnet 46 and so as to be embedded in the developer at the bottom of the housing 5a, and may stir the used developer leaving and dropping from the sleeve 32B' due to gravity and mix such used developer with the developer at the bottom of the housing 5a. Denoted by 40 is a blade for controlling the layer of developer supplied onto the sleeve 45.

The storage chamber 44 has an opening 44a adjacent to the sleeve 32B' through which the magnetic brush 51 on the sleeve 32B' may flow in, and an opening 44b adjacent to the stirring member 26A' through which the developer may flow from the storage chamber 44 into the magnetic brush chamber 43. Disposed within the storage chamber 44 is a feeder shaft 55 for rotating a rotatable member which may stir the developer within the storage chamber and transport the stirred developer into the magnetic brush chamber 43. Secured to the feeder shaft 55 are impellers 56 and 57 which may transport the developer from within the storage chamber 44 into the magnetic brush chamber 43 as the feeder shaft is rotated at a certain slow velocity in the direction of arrow d. A plurality of such impellers 56 and 57 are provided on the feeder shaft 55 axially thereof to transport and stir the developer uniformly.

The number of revolutions of the feeder shaft 55 is determined by the effective life of the developer used and the volume of the developing device and of the storage device.

When being moved, the magnetic brush on the sleeve 32B' may always be closely adjacent to the opening 44a adjacent to the sleeve 32B' in the storage chamber 44, so that a volume of developer equal to the volume of developer transported from the storage chamber 44 into the magnetic brush chamber 43 may flow into the storage chamber 44. This ensures a predetermined value of developer to be procured within the storage chamber 44 and permits the developer to be flowed into and out of such chamber only by the rotation of the feeder shaft 55. Accordingly, a volume of developer equal to the volume of developer supplied from the storage chamber to the reservoir portion of the developing device may flow into the storage chamber to maintain a constant volume of developer in the storage chamber at all times.

In the reservoir portion of the developing device, the volume of developer is also constant at all times to ensure stable conditions for developing.

Figure 6A:
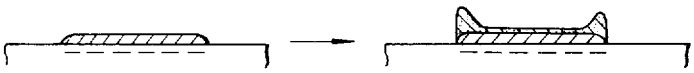
FIGS. 6(A) to 6(C) schematically illustrate the manner of deposition of toner layers in the developing portion of the developing device according to the present invention, in comparison with that according to the prior art.
Figure 6B:
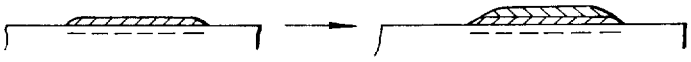
FIG. 6B (PRIOR ART)
Figure 6C:
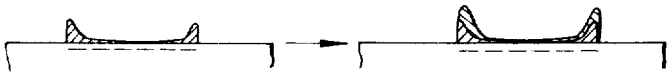

Reference is now had to FIGS. 6(A) to 6(C) to describe the degree of deposition of developer onto the electrostatic image bearing surface in the application of the developing method according to each embodiment of the present invention. FIGS. 6(A) to 6(C) illustrate the manner in which an electrostatic image of one polarity is developed. The left-hand portion illustrates layers of toner deposited on the developed surface when the electrostatic image thereon has come to face the first sleeve, and the right-hand portion illustrates layers of toner deposited on the developed surface when the electrostatic image thereon has come to face the second sleeve.

First, FIG. 6(A) shows the result of the development carried out by the developing device shown in FIGS. 3(A), 4 or 5. It is seen that the electrostatic image bearing surface is initially subjected to the magnetic brush development by the magnetic means having a single pole at the developing position and the sleeve surrounding the magnetic means. This magnetic brush has a form of erection on the magnetic pole and effects development under such a condition that electric lines of force extend perpendicular between the iron powder carrier on the sleeve surface side and the electrostatic charges (in FIG. 6, shown as −) of the electrostatic image to ensure the substantial presence of the developing electrode effect, whereby toner particles of the opposite polarity are deposited on the electrostatic charges. Empirically, such deposited toner has been found to form one to three or four layers. Such first-formed toner layers are schematically shown at the left-hand side of FIG. 6(A). As can be seen, the electric lines of force are not perpendicular but curved in the marginal portion of the electrostatic image, so that the deposition of toner is in somewhat inactive condition.

Subsequently, the second development takes place with the second developing sleeve facing the electrostatic image bearing member, as shown in FIG. 3(A), 4 or 5. As already noted, this development is effected by the use of the developer which has been brought into powder-cloud phase by the repelling magnetic fields formed by the two poles of identical polarity. At this time, therefore, the iron powder carrier is repelled from the sleeve surface and suspended in the air, so that it substantially does not function as the developing electrode and accordingly, the edge effect is pronouncedly presented. As a result, on the developed surface having toner once deposited thereon by the first developing portion, there is obtained a development with an emphasized edge portion of image, namely, deposition of toner, as shown at the right-hand side of FIG. 6(A).

Consequently, on the developed surface after having passed through the first and second developing portions, inactive development (i.e., development lower in edge sharpness) imparted by the first developing portion appears at the marginal portion of the image, but at the second developing portion the marginal portion of the image is emphasized by the edge effect and thus, by the combination of these two different developments, sufficient toner deposition is provided both at the marginal and the central portion of the image, and this is suited to rapid development.

FIGS. 6(B) and 6(C) show, for reference, examples of the prior art or some examples empirically obtained during the process before the present invention was achieved. FIG. 6(B) is an example in which use was made of two sleeves both disposed in opposed relationship with the developing position and each having a single magnetic pole. (Most of the prior arts belong to this type.) As can be seen, the inactive development of the marginal portion of the image was only emphasized but not improved even by the second development after the first development. Thus, toner deposition on the marginal portion was very poor and the developed image was only lean and lacked clarity and sharpness, thus providing a copy of low quality.

FIG. 6(C) refers to the case where use was made of two sleeves both having two magnetic poles of identical polarity for forming repelling magnetic fields in the sleeves. In this case, both the first and the second development resulted in emphasized edge effect, so that toner was deposited on the marginal portion of the image but hardly deposited on the other portions including the central portion, and this again provided a visually very incomplete copy image which would not be suited to rapid development.

The present invention, as described hitherto, provides a developing device using a developing method in which a qualitative difference is afforded between the developing effect of the first developing portion and that of the second developing portion so as to enable obtainment of a visible image conditioned as shown in FIG. 6(A) and in which the two developments are combined so as to mutually compensate for their own demerits.

The number of the sleeves forming the first and second developing portions is not restricted to one for each portion as in the shown embodiments, but, for example, a greater number of sleeves in the first developing portion would enable rapid execution of the development having the feature of the conventional brush developing method, and a greater number of sleeves in the second developing portion would enable rapid execution of the development having the feature of the cascade or the powder-cloud developing method.

Thus, the use of the first developing portion having a single magnetic pole disposed within a sleeve and in opposed relationship with the electrostatic image and the second developing portion having a plurality of magnetic poles of identical polarity disposed within a sleeve and in opposed relationship with the electrostatic image enables rapid execution of a development which is rich in harmony and increased in image sharpness. Unlike the other high-speed developing devices wherein a plurality of first developing portions or a plurality of second developing portions is simply provided, the present invention enables a development corresponding to the condition of an electrostatic image to be rapidly carried out by suitably selecting the locations of the magnetic poles, the strength of the magnetic fields and the number of sleeves for the first or the second developing portion.

What we claim is:

1. A device for developing latent images carried on a movable surface, comprising:

a container for containing developer therein;

first magnetic means supported in said container for producing a first magnet field, said first magnetic means having a single magnetic pole disposed at a developing position opposed to the surface to be developed;

a first non-magnetic member interposed between the surface to be developed and said first magnetic means, said first non-magnetic member being movable relative to said first magnetic means in the same direction as the movable surface to be developed at the developing position;

a second magnetic means supported in said container in spaced relation to said first magnetic means for producing a second magnetic field, said second magnetic means having adjacent magnetic poles of identical polarity disposed at the developing position;

a second non-magnetic member interposed between the surface to be developed and said second magnetic means, said second non-magnetic member being movable relative to said second magnetic means in the same direction as the movable surface to be developed at the developing position, said adjacent poles of identical polarity being effective to produce repelling fields therebetween which repel developer from the surface of the second non-magnetic member at the developing position, said first and second magnetic means being arranged to provide downward or horizontal passage of developer through the repelling fields and said second non-magnetic member being disposed downstream of said first non-magnetic member with respect to the movement direction of the surface to be developed; and means for applying developer from said container only to said first non-magnetic member for development of a latent image on the movable surface, the developer then being transported from said first non-magnetic member to the second non-magnetic member to further develop the latent image by another application of developer.

2. A device according to claim 1, wherein said first and second non-magnetic members are disposed in parallel and horizontal relationship with respect to the surface to be developed.

3. A device according to claim 1, wherein said first non-magnetic member is downwardly movable at said developing position.

4. A device according to claim 1, wherein said second non-magnetic member is downwardly movable at said developing position so that the force of gravity aids the repelling force of the magnetic field between said identical poles to project the developer onto the surface to be developed.

5. A device for developing images carried on a movable surface, comprising:

a container for containing developer therein;

means for supplying developer into said container;

a first magnetic member fixedly supported in said container for producing a first magnetic field, said first magnetic member having a single magnetic pole at a developing position opposed to the surface to be developed;

a first non-magnetic rotatable member surrounding said first magnetic member for rotation to convey developer into the developing position and apply the developer to the surface to be developed;

a second magnetic member fixedly supported in said container in spaced relation to said first magnetic member, said second magnetic member having therewithin adjacent magnetic poles of identical polarity, said adjacent poles being disposed at a developing position opposed to the surface to be developed;

a second non-magnetic rotatable member surrounding said second magnetic member for rotation to convey developer, attracted thereto by said second magnetic fields, intos said developing position to apply the developer to the surface to be developed, said second magnetic poles of identical polarity being effective to form repelling magnetic fields therebetween at the position opposed to the surface to be developed and to form magnetic brushes of the developer in a repelling relationship with each other, said first and second non-magnetic rotatable members being arranged to provide downward or horizontal passage of the developer through the repelling fields of said second magnetic member, and said second non-magnetic rotatable member being disposed downstream of said first non-magnetic rotatable member with respect to the movement direction of the surface to be developed; and means for applying developer from said container only to said first non-magnetic rotatable member for development of a latent image on the movable surface, said first and second non-magnetic rotatable members being rotatable at the developing position, in the same direction as said movable surface to be developed such that the developer from the first non-magnetic rotatable member is transported to the second non-magnetic rotatable member.

6. A device according to claim 5, wherein said first and second non-magnetic rotatable members rotate at higher speed than the peripheral speed of the movable surface to be developed.

7. A device according to claim 5, further comprising developer control means provided in a predetermined spaced apart relationship with the surface of said first non-magnetic rotatable member.

8. A device according to claim 5, further comprising developer control means provided in a predetermined spaced apart relationship with the surface of said second non-magnetic rotatable member.

9. A device according to claim 5, further comprising a third magnetic member and a third non-magnetic rotatable member surrounding said third magnetic member for conveying developer in the container to either the first or the second non-magnetic rotatable member which is nearest thereto.

10. An apparatus for developing latent images on an image bearing member, comprising:

a housing adapted for storing a quantity of magnetically attractable developer material;

a first cylindrical applicator member of non-magnetic material rotatably mounted in said housing for transporting a quantity of developer material into developing relation with the image bearing member having a latent image thereon;

first magnetic means enclosed in said first applicator member having a single magnetic pole at a developing position for generating a first magnetic field extending in an axial direction relative to said applicator member;

a second cylindrical applicator member of non-magnetic material rotatably mounted in spaced apart relationship with said first cylindrical applicator member in said housing for transporting a quantity of developer material into developing relation with the image bearing member having a latent image thereon; and second magnetic means enclosed in said second applicator member having at least two identical magnetic poles closely spaced from each other at said developing position for generating therebetween at least two repelling magnetic lines of force extending in an axial direction relative to said applicator member, said two identical magnetic poles having the magnetic polarity opposite to the polarity of said first magnetic pole, thereby facilitating transportation of developer between the first and the second applicator members, said first and second cylindrical applicator members being arranged to provide downward or horizontal passage of developer through the repelling fields of said second magnetic means, and said second applicator member being disosed downstream of said first applicator member with respect to the movement of the surface to be developed; and means for applying developer from said housing only to said first cylindrical applicator member for development of a latent image on the movable surface, said first and second cylindrical applicator members being rotatable at the developing position, in the same direction as said movable surface to be developed such that the developer is transported from the first cylindrical applicator member to the second cylindrical applicator member.

11. In an apparatus for developing a latent image on an image bearing member adapted to be driven so as to pass through a developing station, comprising a container for a developer mix, a magnetic field producing means supported in said container, a cylindrical applicator of non-magnetic material enclosing said magnetic field producing means and movable relative thereto to convey the developer mix to the developing station so that the developer mix takes a magnetic brush form of sufficient height at the developing position to contact said image bearing member, the improvement comprising:

a first magnetic pole disposed in said magnetic field producing means at a position corresponding to the image developing station of the apparatus;

second and third magnetic poles having an identical polarity to produce a pair of repelling magnetic lines of force therebetween, said second and third magnetic poles being spaced apart from said first magnetic pole and the polarity of which is opposite to the polarity of the first magnetic pole, thereby to facilitate transportation of developer between the first magnetic pole and the second and the third magnetic poles;

a first cylindrical applicator of non-magnetic material enclosing said first magnetic pole;

a second cylindrical applicator of non-magnetic material enclosing said second and third magnetic poles, said first and second cylindrical applicators being arranged to provide downward or horizontal passage of developer through the repelling fields of said second and third poles, and said second cylindrical applicator being disposed downstream of said first cylindrical applicator with respect to the movement of the surface to be developed; and means for applying developer from said container only to said first cylindrical applicator for development, said first and second cylindrical applicators being rotatable, at the developing position, in the same direction of said movable surface to be developed to continuously transport the developer mix past the first, second and third poles, in that order.

12. Developing apparatus for use in applying toner to a latent image carriage on a movable surface, said apparatus comprising:

a first developing station for applying toner to said latent image;

a second developing station for applying toner to said electrostatic image, said second developing station being effective to form repelling magnetic fields to cause toner to jump to said latent image;

means for defining an open space between said first and second developing stations adjacent to said movable surface for transporting toner over said open space without developing; and means for applying toner from a toner sump only to said first developing station for development;

said first developing station having a single magnetic pole at the developing position thereof without an adjacent magnetic pole after said single magnetic pole along the toner transporting path to said second developing station thereby to effect continuous toner transportation over said open space, said first and second developing stations being arranged to provide downward or horizontal passage of toner through said repelling magnetic fields, and said second developing station being disposed downstream of said first developing station with respect to the movable latent image carrying surface.

13. Developing apparatus for use in applying toner to a latent image carried on a movable surface, said apparatus comprising:

a first magnetic brush forming means;

a second magnetic brush and powder-cloud-like toner forming means; and means for defining an open space adjacent to said movable surface between said first and second magnetic brushes to facilitate development by said first magnetic brush and by said powder-cloud-like toner forming means; and means for applying toner from a toner sump only to said first magnetic brush forming means for development;

said first magnetic brush forming means having a single magnetic pole at the developing position thereof without an adjacent magnetic pole after said single magnetic pole along the toner transporting path to said second magnetic brush and powder-cloud-like toner forming means to thereby effect continuous toner transportation over said open space, said first and second forming means being arranged to provide downward or horizontal passage of toner across said second forming means, and said second forming means being disposed downstream of said first forming means with respect to the movable surface carrying a latent image thereon.

14. In an apparatus for producing a latent image which includes means for sensitizing the surface of an image reproducing body, means to expose the sensitized and exposed surface with toner, means to transfer the toner image to a copy medium and means to strip the toner bearing copy medium from the surface of the image reproducing body, the improvement comprising:

a first toner applying means for applying toner to said sensitized and exposed surface;

a second toner applying means for applying toner to said sensitized and exposed surface, said second toner applying means being effective to produce repelling magnetic forces to repel toner to said sensitized and exposed surface;

means for defining an air gap between said first and second toner applying means, wherein there is no toner application to the portion of said surface adjacent to said air gap; and means for applying toner from a toner sump only to said first toner applying means for development;

said first toner applying means having a single magnetic pole at the developing position thereof without an adjacent magnetic pole after said single magnetic pole along the toner transporting path to said second toner applying means to thereby effect continuous toner transportation over said open space, said first and second toner applying means being arranged to provide downward or horizontal passage of toner through the repelling magnetic fields of said second toner applying means, and said second toner applying means being disposed downstream of said first toner applying means with respect to the movable surface carrying a latent image thereon.

15. Developing apparatus for use in applying toner to a latent image carried on a movable surface, said apparatus comprising:

a single magnetic brush forming means for applying toner to said movable surface;

means for forming a pair of magnetic brushes and a toner powder cloud therebetween for applying toner to said movable surface substantially by the use of the edge effect of said toner powder cloud;

means for defining an air space between said single magnetic brush and said pair of magnetic brushes; and means for applying from a toner sump toner only to said single magnetic brush forming means for development;

said single magnetic brush forming means having a single magnetic pole at the developing position thereof without an adjacent magnetic pole after said single magnetic pole along the toner transporting path to said means for forming a pair of magnetic brushes and a toner powder cloud to thereby effect continuous toner transportation over said air space, said single magnetic brush forming means and said means for forming a pair of magnetic brushes and a toner powder cloud being arranged to provide downward or horizontal passage of toner across said means for forming a pair of magnetic brushes and a toner powder cloud, and said means for forming a pair of magnetic brushes and a toner powder cloud being disposed downstream of said single magnetic brush forming means with respect to the movable surface carrying a latent image thereon.

* * * * *